US007971711B2

(12) United States Patent
Squarzoni et al.

(10) Patent No.: US 7,971,711 B2
(45) Date of Patent: Jul. 5, 2011

(54) FOLDED AND SEALED COUPON INSERTABLE IN PACKS CONTAINING TOBACCO PRODUCTS, AND A BLANK FROM WHICH TO FASHION THE COUPON

(75) Inventors: Michele Squarzoni, Ferrara (IT); Nicola Peratello, Bondeno (IT); Roberto Polloni, Modigliana (IT); Stefano Negrini, Calderara Di Reno (IT)

(73) Assignee: G.D S.p.A. (IT)

( * ) Notice: Subject to any disclaimer, the term of this patent is extended or adjusted under 35 U.S.C. 154(b) by 229 days.

(21) Appl. No.: 11/783,908

(22) Filed: Apr. 13, 2007

(65) Prior Publication Data

US 2007/0241004 A1 Oct. 18, 2007

(30) Foreign Application Priority Data

Apr. 13, 2006 (IT) ..... BO2006A0274

(51) Int. Cl.
*A24F 15/00* (2006.01)
*G09F 3/10* (2006.01)

(52) U.S. Cl. ..... 206/242; 206/830; 40/312; 40/672

(58) Field of Classification Search ..... 206/242, 206/831, 232; 229/70, 92.1; 40/312, 360, 40/306, 310, 672; 283/56, 62, 63.1, 116, 283/105, 106, 51; 281/2, 3.1, 5
See application file for complete search history.

(56) References Cited

U.S. PATENT DOCUMENTS

| | | | | |
|---|---|---|---|---|
| 202,589 | A * | 4/1878 | Rogers | 229/92.7 |
| 3,426,961 | A * | 2/1969 | Allison | 229/70 |
| 3,695,422 | A * | 10/1972 | Tripodi | 206/232 |
| 3,734,544 | A * | 5/1973 | Fishkin et al. | 283/56 |
| 4,513,993 | A * | 4/1985 | Brown | 283/103 |
| 4,540,880 | A * | 9/1985 | Hipko | 235/487 |
| 4,830,406 | A * | 5/1989 | Instance | 283/81 |
| 4,967,951 | A * | 11/1990 | Sherman | 229/70 |
| 5,035,935 | A * | 7/1991 | Thomas et al. | 428/43 |
| 5,363,955 | A * | 11/1994 | Fleenor | 206/273 |
| 5,490,692 | A * | 2/1996 | Howard | 283/81 |
| 5,533,613 | A * | 7/1996 | Minarelli et al. | 206/268 |
| 6,105,340 | A * | 8/2000 | Draghetti | 53/415 |
| 6,158,777 | A * | 12/2000 | Twardosz | 283/62 |
| 6,467,614 | B1 * | 10/2002 | Tallier et al. | 206/264 |
| 6,572,149 | B2 * | 6/2003 | Long | 283/51 |
| 6,681,927 | B2 * | 1/2004 | Focke et al. | 206/268 |
| 7,331,451 | B2 * | 2/2008 | Focke et al. | 206/264 |

* cited by examiner

*Primary Examiner* — J. Gregory Pickett
*Assistant Examiner* — Ernesto A Grano
(74) *Attorney, Agent, or Firm* — Timothy J. Klima; Shuttleworth & Ingersoll, PLC

(57) ABSTRACT

A folded and sealed cigarette coupon is inserted typically between the outermost face of a cigarette packet and its transparent overwrap. The coupon is fashioned from a flat blank divided by crease lines into a set of panels and extended at either end to create a corresponding set of flaps. The panels are quarto folded to form a substantially rectangular main body of the coupon with the flaps combining to form a grippable closure tab along one edge of the body, which can be torn off to open the coupon. The flaps making up the tab are equal in number to the folded panels, so that the thickness of the coupon remains uniform from edge to edge in both length and breadth.

14 Claims, 3 Drawing Sheets

FOLDED AND SEALED COUPON INSERTABLE IN PACKS CONTAINING TOBACCO PRODUCTS, AND A BLANK FROM WHICH TO FASHION THE COUPON

This application claims priority to Italy Patent Application No. BO2006A 000274, filed Apr. 13, 2006, which application is incorporated by reference herein.

BACKGROUND OF THE INVENTION

The present invention relates to a folded and sealed coupon insertable in a pack serving to contain tobacco products, and to a blank from which a coupon of the type in question is fashioned.

In particular, the invention relates to a cigarette coupon furnished with a tamper-resistant closure and insertable in a retail pack. More exactly, coupons of this description are interposed typically between a packet of cigarettes, or a carton containing multiple packets of cigarettes, and a relative overwrap layer formed from a leaf of transparent material.

Conventionally, folded coupons are prepared from a blank appearing as a substantially rectangular flat sheet, with crease lines placed so as to delimit a set of panels superposable one on another by means of suitable folding steps. The blank also presents flaps projecting from the ends of respective panels and superposable similarly one on another as a result of the aforementioned folding steps.

Once the panels and flaps have been folded, the flaps are gummed and sealed together, in such a way as to fashion a coupon of closed, tamper-resistant design appearing as an essentially rectangular body with a grippable appendage providing a tear-off tab.

In general, coupons of the type in question will carry information of a confidential nature on the inside faces of the folded panels, intended for the eyes only of the individual purchasing the pack. For example, coupons with a tamper-resistant closure can be used to announce prize draw competitions, or as envelopes in which to place further paper inserts.

To facilitate the step of opening the coupon, the blank is scored with perforation lines between the panels and the respective flaps.

To reiterate, the coupons are associated with packs of tobacco products, such as packets of cigarettes, in such as way as to remain visible from the outside.

Accordingly, the coupon is placed between the outer surface of the cigarette packet and a protective transparent overwrap, provided generally by a leaf of heat-shrinkable sheet plastic material folded around the packet and then warmed in such a manner as will cause it to stretch tight across the outer surface.

To form the tamper-resistant closure on the coupon, normally, a flap projecting from one end of one outer face presented by the coupon is folded, gummed and secured to a flap projecting from the opposite outer face.

With this style of closure, the grippable tear-off portion presents a thickness different from that presented by the main body of the coupon.

Consequently, where a coupon is associated with the pack, the operation of welding and/or heat-shrinking the overwrap can lead to the formation of creases in the transparent material, caused by the difference or discontinuity in thickness between the body of the coupon and the tear-off portion.

This same disparity in thickness of the coupon can also occasion drawbacks affecting the manner in which the coupons are stored in the overwrapping unit. In effect, the packs are overwrapped, and the coupons inserted, by machine units equipped with a hopper in which the coupons are stacked one on top of another. The coupons do not stack properly by reason of the fact that they will tend to assume a position angled downward toward the appendages which, as intimated previously, are thinner than the folded panels.

The object of the present invention is to provide a folded and sealed coupon insertable in packs for tobacco products, and a blank from which to fashion the coupon, such as will be unaffected by the above noted drawbacks.

One particular object of the present invention is to provide a folded and sealed coupon that can be overwrapped without giving rise to the formation of creases in the overwrap material.

SUMMARY OF THE INVENTION

The stated object is realized according to the present invention in a folded and sealed coupon insertable in packs containing tobacco products, composed of main body presenting a plurality of panels superposable one on another, and a grippable, forcibly removable appendage functioning as a closure, adjoining the main body and consisting in a plurality of superposable flaps extending from respective panels, wherein the flaps making up the grippable appendage are equal in number to the panels making up the main body.

The aforementioned object is realized similarly in a blank from which to fashion a coupon insertable in a pack containing tobacco products, substantially of rectangular outline and comprising a plurality of panels delimited by a longitudinal crease line and a transverse crease line, and a plurality of flaps projecting from the panels, wherein the number of flaps is equal to the number of panels.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
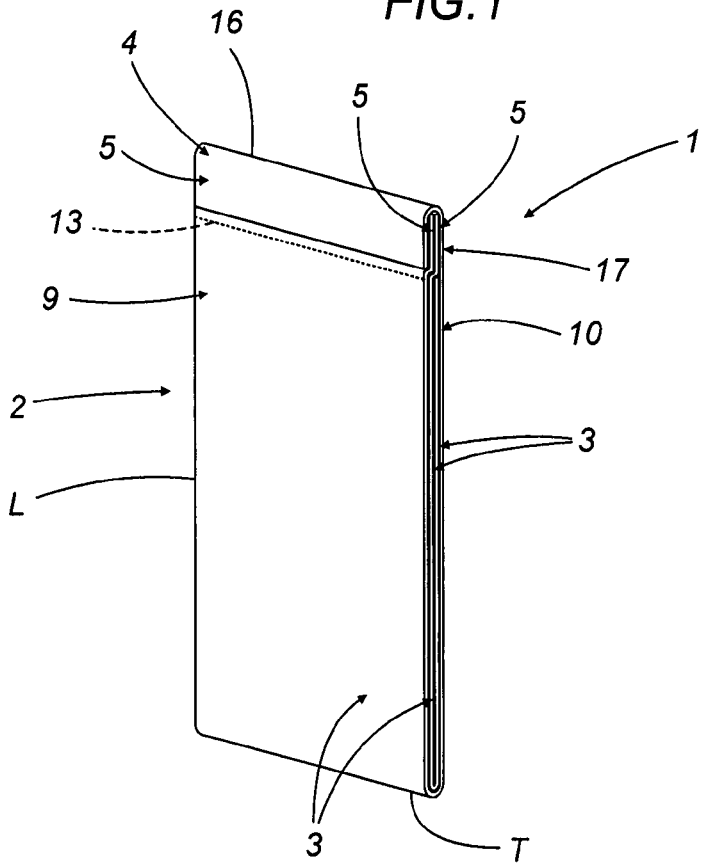
FIG. 1 shows a folded and sealed coupon according to the present invention, viewed in perspective.

Referring to FIG. 1 of the drawings, numeral 1 denotes a folded and sealed coupon.

The present invention relates specifically to a folded and sealed coupon 1 such as can be associated with packs containing tobacco products, typically packets of cigarettes, interposed for example between one outer face of a single packet and the relative covering of transparent overwrap material.

The coupon 1 comprises a substantially rectangular main body 2 consisting in a plurality of panels 3 superposed one on another, and a grippable appendage, or tab 4, projecting from and adjoining one end or one side of the body 2.

In particular, the aforementioned appendage 4 is associated with one end 2*a* of the main body 2 and consists in a plurality of flaps 5, superposed one on another and sealed in at least one predetermined area. Thus, the coupon 1 can be opened up by removing the grippable appendage 4, as will become clear in the course of the present specification.

Figure 6:
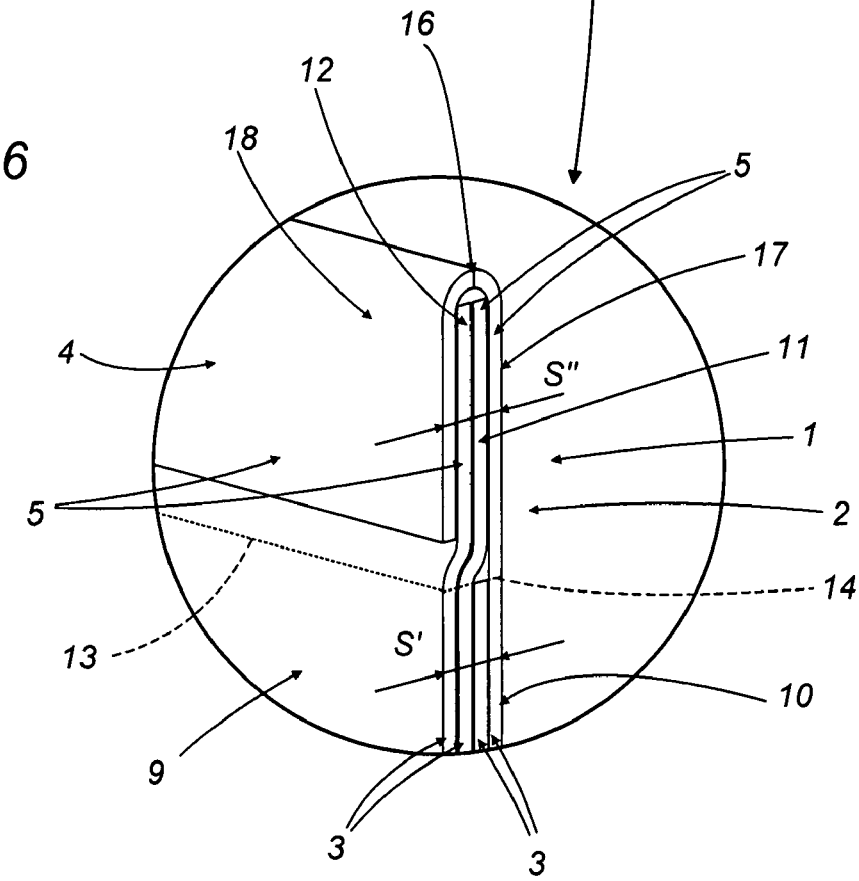
FIG. 6 shows an enlarged detail of FIG. 5, viewed in perspective.

As readily discernible from FIG. 1 and FIG. 6, the main body 2 presents a plurality of panels 3 equal in number to the number of flaps 5 making up the grippable appendage 4.

More precisely, the main body 2 consists of four such panels 3 offered in face to face contact one to another, and the appendage 4 likewise consists of four flaps 5 offered in contact one to another.

Figure 2:
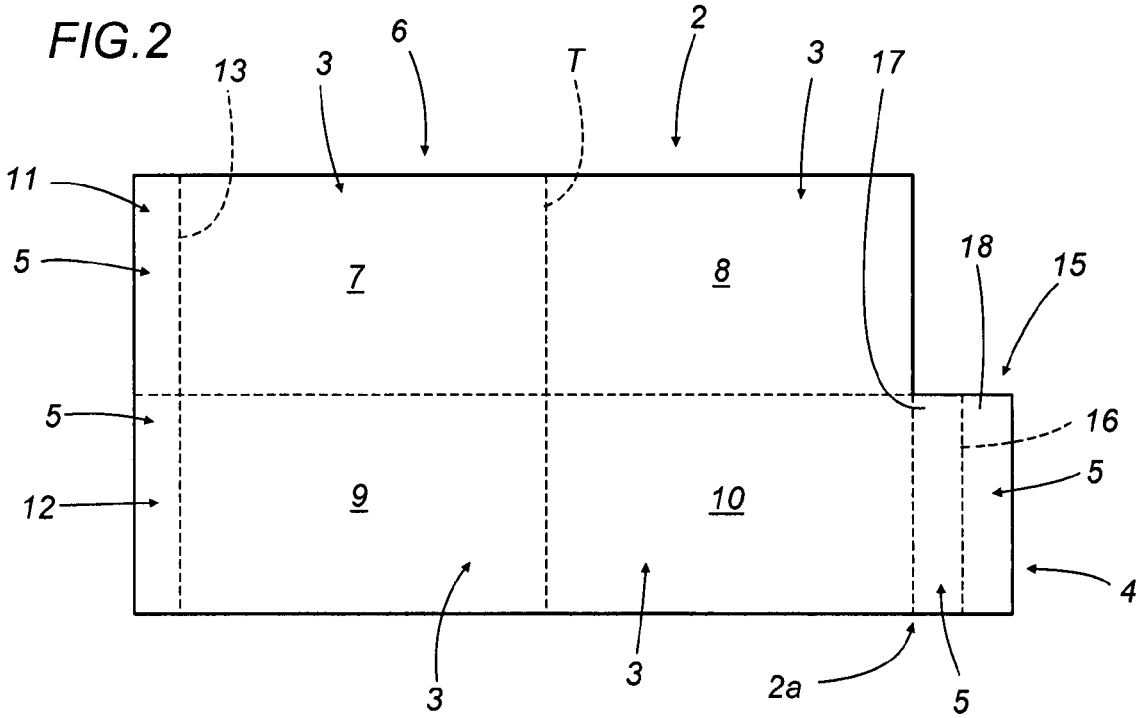
FIG. 2 is the plan view of a blank from which to fashion the coupon of FIG. 1.

With reference also to FIG. 2, the coupon 1 is obtained from a substantially rectangular blank 6 divided by a longitudinal crease line L and by a transverse crease line T into four rectangular panels denoted 7, 8, 9 and 10, identical one to another.

The faces of the panels 7, 8, 9 and 10 visible in FIG. 2 are those on which text, pictures or other printed matter will appear.

The panels 7 and 9 on the left of the transverse crease line T, as viewed in FIG. 2, are furnished along the edges remote from the crease line T with respective flaps 11 and 12 identical one to another and joined to the panels along a perforation line 13. The end of the panel denoted 10 positioned remote from the transverse crease line T is extended, beyond a relative perforation line 14, to form a tongue 15 divided by a crease line 16 into two flaps 17 and 18 identical one to another and to the flaps 11 and 12 mentioned previously.

Figure 3:
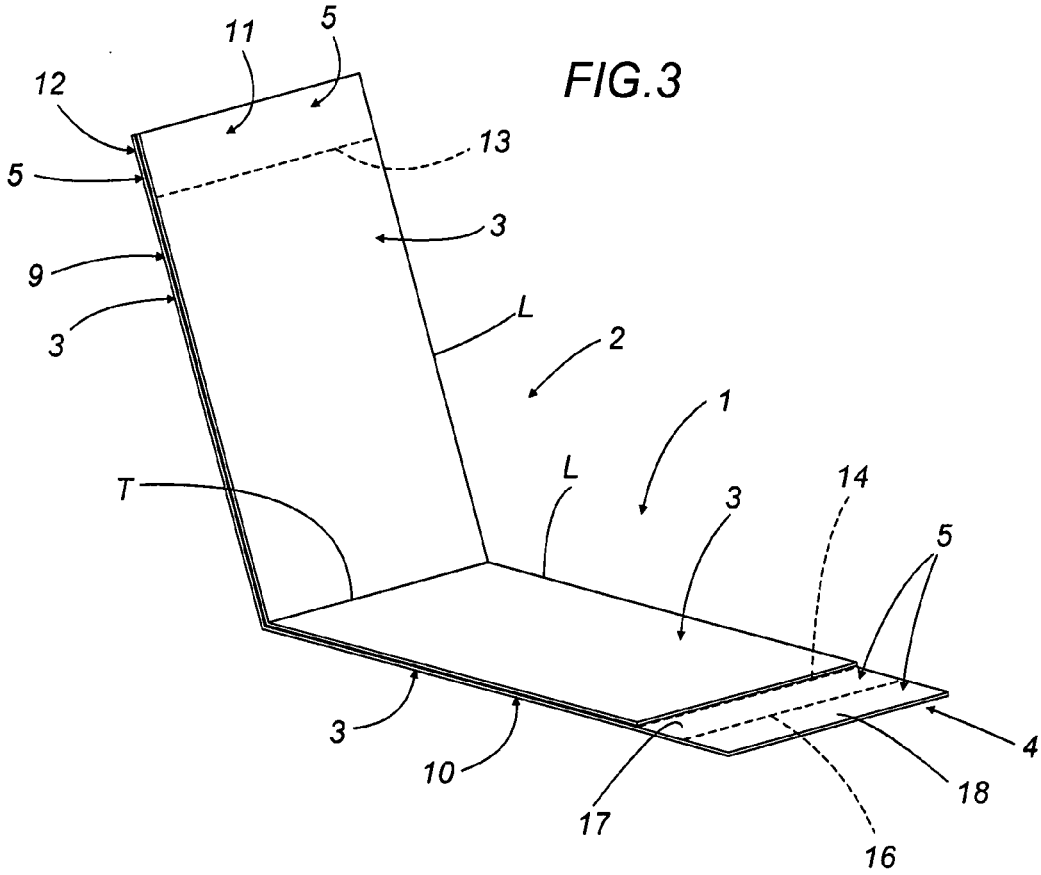
FIGS. 3 and 4 are perspective views of the blank in FIG. 2, shown in two successive partially folded configurations assumed in the process of fashioning the coupon as in FIG. 1.
Figure 4:
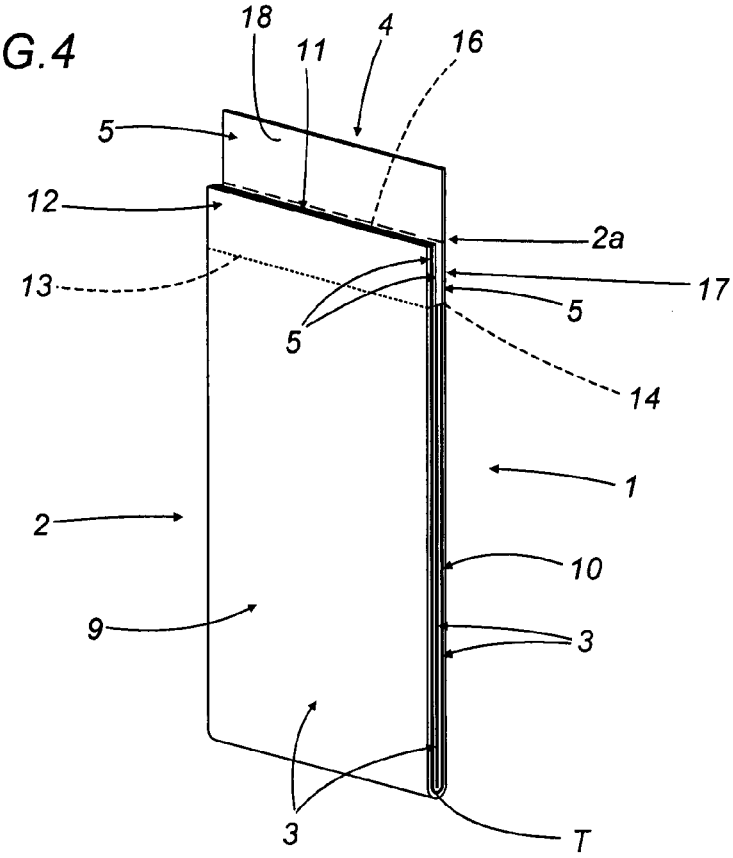

Referring to FIGS. 3 and 4, the sequence of folds required to fashion the blank 6 into a coupon 1 as illustrated in FIG. 1 will now be described.

The two panels denoted 7 and 8 and the associated flap 11 are rotated 180° about the longitudinal crease line L in a counterclockwise direction, as viewed in FIG. 3, so as to position the flap 11 and the two panels 7 and 8 in face to face contact with the adjoining flap 12 and the two adjoining panels 9 and 10, respectively. The outer faces of the latter two panels 9 and 10 will be the faces of the folded coupon 1 ultimately remaining exposed to view.

Thereafter, a further 180° fold is made in the clockwise direction, as viewed in FIG. 3, whereby the portion composed of the two flaps 11 and 12 and the two panels 7 and 9 brought together by making the first fold are rotated as one about the transverse crease line T in such a way that the panel denoted 7 is offered directly to the panel denoted 8, and the innermost flap 11 offered to the flap denoted 17, as illustrated in FIG. 4.

The closure of the coupon 1 is completed by causing the endmost flap 18, or closure flap, to bend around the crease line 16 and rotate into a position of full frontal contact with the flap 12 still exposed on the opposite face. In this way, all the elements making up the two portions of the blank 6, namely the folded pair of panels denoted 7 and 9, and the folded pair of panels denoted 8 and 10, are flattened and secured together.

The aforementioned closure step is preceded by a gumming step in which a layer of adhesive is applied to the face of the closure flap 18 destined to bond with the flap 12 against which it is folded. It will be seen in FIG. 6 that the thickness "S" of the grippable appendage 4 thus created is equal to the thickness presented by the body 2 of the coupon 1, and more exactly, the combined thicknesses presented by the two portions of the coupon 1 are equal to four times the thickness of the blank 6.

Figure 5:
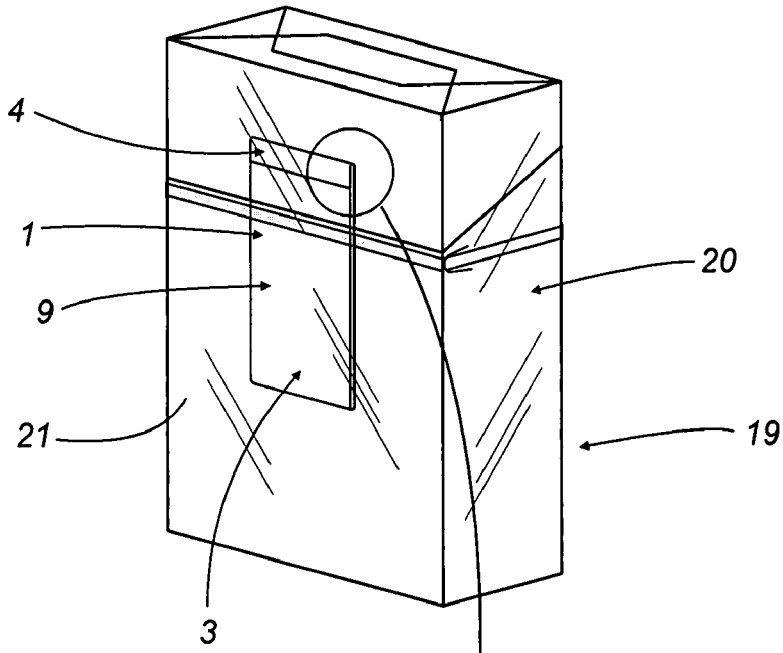
FIG. 5 shows a packet of cigarettes furnished with the coupon of FIG. 1, viewed in perspective.

FIG. 5 shows the coupon 1 associated with a pack consisting in a packet of cigarettes 19.

The packet 19 comprises a container 20 proportioned to accommodate a group of cigarettes not visible in the accompanying drawings. The container 20 is of parallelepiped shape, and enveloped in an overwrap 21 that provides a protective outer covering for the packet 19. The overwrap 21 is made of a transparent and heat-shrinkable material.

A folded coupon 1 of the type described above can be inserted between the transparent overwrap 21 and the container 20, in such a way as to remain visible from the outside.

As discernible in FIG. 5, the coupon 1 is placed with one panel 3 offered to an outside face of the container 20, and held in contact with the container through the agency of the overwrap 21.

The overwrap 21 is shrunk by the application of heat, and made thus to hug the container 20 and the coupon 1 tightly.

The overwrap 21 adapts faultlessly to the coupon 1, since the thickness of the coupon is uniform across its entire length and breadth.

This self-evident advantage derives from the fact that the number of panels 3 making up the main body 2 of the coupon 1 is matched by the number of flaps 5 making up the grippable appendage 4.

What is claimed is:

1. A folded and sealed coupon insertable in packs containing tobacco products, comprising:

a main body having a plurality of panels with each panel superposed on each other panel; the main body having first, second, third and fourth panels separated from each other by a first crease line and a second crease line transverse to the first crease line such that the first and second panels are separated by the first crease line, the third and fourth panels are separated by the first crease line, and the first and second panels are separated from the third and fourth panels by the second crease line;

wherein the first panel and the fourth panel are superposed respectively on the second panel and the third panel by a folding along the first crease line such that respective inside faces of the panels are in contact one with another, wherein the first and second panels are superposed on the fourth and third panels by a folding along the second crease line, such that respective faces of the first panel and fourth panel are in contact one with another and the folding along the second crease line closes one edge of the main body;

one grippable appendage adjoining one edge of the main body and removable from the main body to open the coupon, the grippable appendage formed from a plurality of flaps extending away from one side of the superposed panels of the main body with each flap superposed on each other flap, wherein a number of flaps making up the grippable appendage is the same as a number of panels making up the main body, the plurality of superposed flaps comprising a first flap and a second flap joined respectively to the first panel and the second panel along a perforation line; a third flap joined to the third panel along a perforation line; a fourth flap; a flap crease line joining the fourth flap to only the third flap, the fourth flap not being directly connected to any of the panels; the first flap being positioned between the second flap and the third flap, and the fourth flap being folded along the flap crease line to extend in a direction back toward the panels to superpose and be sealed to an outside face of the second flap.

2. A coupon as in claim 1, wherein a cross-sectional thickness of the main body is identical to a cross sectional thickness of the grippable appendage.

3. A coupon as in claim 1, wherein cross-sectional thickness of the main body and also of the grippable appendage is equivalent to four times a thickness of a flat blank from which the coupon is folded.

4. A coupon as in claim 1, wherein, upon removal of the grippable appendage from the main body, the plurality of flaps is entirely separated from the plurality of panels.

5. A blank from which to fashion a folded and sealed coupon insertable in packs containing tobacco products, comprising:

first, second, third and fourth panels separated from each other by a first crease line and a second crease line transverse to the first crease line such that the first and second panels are positioned on opposite sides of the first crease line, the third and fourth panels are positioned on opposite sides of the first crease line, the first and second panels are positioned on one side of the second crease line and the third and fourth panels are positioned on an opposite side of the second crease line;

a plurality of flaps projecting from the panels, wherein the plurality of flaps is equal in number to the number of the panels and wherein the panels are identical in size and shape to one another, the plurality of flaps comprising a first flap and a second flap positioned at one end of the blank and joined respectively to the first panel and the second panel along a perforation line, the first flap and second flap extending away from the first panel and the second panel, respectively, in a first direction parallel to the first crease line, a tongue being positioned at an opposite end of the blank, the tongue including a third flap joined to the third panel along a perforation line and extending away from the third panel in a second direction opposite to the first direction and also parallel to the first crease line; the tongue also including a fourth flap joined only to the third flap by a flap crease line and extending away from the third flap in the second direction.

6. A blank as in claim 5, wherein the fourth flap is a closure flap that is foldable along the flap crease line to overlap each of the first, second and third flaps when the blank has been folded along the first and second crease lines to superpose the second, first and third flaps, the fourth flap then being fastenable to an outside face of the second flap to seal the folded coupon.

7. A blank as in claim 5, wherein the first panel and the fourth panel are superposable respectively on the second panel and the third panel by folding along the first crease line, thereby bringing respective inside faces of the panels into contact one with another, as well as bringing inside faces of the first flap and second flap associated with the first panel and the second panel into contact one with another.

8. A blank as in claim 7, wherein the superposed first and second panels are rotatable about the second crease line and into contact with the superposed fourth and third panels, thereby bringing respective faces of the first panel and fourth panel into contact one with another, bringing an inside face of the third flap associated with the third panel into contact with an outside face of the first flap associated with the first panel, and closing an edge of the folded blank along the second crease line, whereupon a gummed face of the fourth flap can be offered and sealed to an outside face of the second flap.

9. A packet of cigarettes comprising:

a container occupied by a group of cigarettes;

an overwrap of heat-shrinkable material enveloping the container;

a folded and sealed coupon inserted between the overwrap and the container, the folded and sealed coupon comprising:

a main body having a plurality of panels with each panel superposed on each other panel; the main body having first, second, third and fourth panels separated from each other by a first crease line and a second crease line transverse to the first crease line such that the first and second panels are separated by the first crease line, the third and fourth panels are separated by the first crease line, and the first and second panels are separated from the third and fourth panels by the second crease line;

wherein the first panel and the fourth panel are superposed respectively on the second panel and the third panel by a folding along the first crease line such that respective inside faces of the panels are in contact one with another, wherein the first and second panels are superposed on the fourth and third panels by a folding along the second crease line, such that respective faces of the first panel and fourth panel are in contact one with another and the folding along the second crease line closes one edge of the main body;

one grippable appendage adjoining one edge of the main body and removable from the main body to open the coupon, the grippable appendage formed from a plurality of flaps extending away from one side of the superposed panels of the main body with each flap superposed on each other flap, wherein a number of flaps making up the grippable appendage is the same as a number of panels making up the main body, the plurality of superposed flaps comprising a first flap and a second flap joined respectively to the first panel and the second panel along a perforation line; a third flap joined to the third panel along a perforation line; a fourth flap; a flap crease line joining the fourth flap to only the third flap, the fourth flap not being directly connected to any of the panels; the first flap being positioned between the second flap and the third flap, and the fourth flap being folded along the flap crease line to extend in a direction back toward the panels to superpose and be sealed to an outside face of the second flap.

10. A packet as in claim 9, wherein, upon removal of the grippable appendage from the main body, the plurality of flaps is entirely separated from the plurality of panels.

11. A folded and sealed coupon insertable in packs containing tobacco products, comprising:

a main body having a plurality of panels with each panel superposed on each other panel to form a stack of panel layers;

one grippable appendage adjoining one edge of the main body and removable from the main body to open the coupon, the grippable appendage formed from a plurality of flaps extending from the panels of the main body with each flap superposed on each other flap to form a stack of flap layers, wherein a number of flap layers making up the grippable appendage is the same as a number of panel layers making up the main body;

the coupon being constructed from a blank having first, second, third and fourth panels separated from each other by a first crease line and a second crease line transverse to the first crease line such that the first and second panels are positioned on opposite sides of the first crease line, the third and fourth panels are positioned on opposite sides of the first crease line, and the first and second panels are positioned on one side of the second crease line and the third and fourth panels are positioned on an opposite side of the second crease line;

wherein the plurality of flaps is equal in number to the number of the panels and wherein the panels are identical in size and shape to one another, the plurality of flaps comprising a first flap and a second flap positioned at one end of the blank and joined respectively to the first panel and the second panel along a perforation line, the first flap and second flap extending away from the first panel and the second panel, respectively, in a first direction parallel to the first crease line, a tongue being positioned at an opposite end of the blank, the tongue including a third flap joined to the third panel along a perforation line and extending away from the panel in a second direction opposite to the first direction and also parallel to the first crease line; the tongue also including a fourth flap joined only to the third flap by a flap crease line and extending away from the third flap in the second direction.

12. A coupon as in claim 11, wherein, upon removal of the grippable appendage from the main body, the plurality of flaps is entirely separated from the plurality of panels.

13. A coupon as in claim 11, wherein the first panel and a fourth panel are superposable respectively on the second panel and the third panel by folding along the first crease line, thereby bringing respective inside faces of the panels into contact one with another, as well as bringing inside faces of the first flap and second flap associated with the first panel and the second panel into contact one with another.

14. A coupon as in claim 11, wherein the superposed first and second panels are rotatable about the second crease line and into contact with the superposed fourth and third panels, thereby bringing respective faces of the first panel and fourth panel into contact one with another, bringing an inside face of the third flap associated with the third panel into contact with an outside face of the first flap associated with the first panel, and closing one edge of the coupon along the second crease line, whereupon a gummed face of the fourth flap can be offered and sealed to an outside face of the second flap.

* * * * *